US005954098A

United States Patent [19]

Speich

[11] Patent Number: 5,954,098

[45] Date of Patent: Sep. 21, 1999

[54] MECHANICAL LOOM

[75] Inventor: Francisco Speich, Gipf-Oberfrick, Switzerland

[73] Assignee: Textilma AG, Switzerland

[21] Appl. No.: 09/011,287

[22] PCT Filed: Aug. 6, 1996

[86] PCT No.: PCT/CH96/02730

§ 371 Date: Feb. 11, 1998

§ 102(e) Date: Feb. 11, 1998

[87] PCT Pub. No.: WO97/09477

PCT Pub. Date: Mar. 13, 1997

[30] Foreign Application Priority Data

Sep. 6, 1995 [DE] Germany ..... 295 14 298 U

[51] Int. Cl.[6] ..... D03D 47/42

[52] U.S. Cl. ..... 139/431

[58] Field of Search ..... 139/431, 432

[56] References Cited

U.S. PATENT DOCUMENTS 3,996,971 12/1976 Grifith et al. ..... 139/431
4,006,758 2/1977 Libby ..... 139/431
4,688,598 8/1987 Klos ..... 139/431

FOREIGN PATENT DOCUMENTS 2166093 8/1993 France ..... 139/431
94 20 562 3/1995 Germany ..... 139/431

*Primary Examiner*—Andy Falik
*Attorney, Agent, or Firm*—George Pappas

[57] ABSTRACT

In a mechanical loom, a weft insertion needle (28) feeds a loop of weft thread (30) into a shed (26). On the opposite side of the shed is a knitting needle (32) which ties the loop of weft thread (30). The weft insertion needle (28) and the knitting needle (32) are disposed such that the side (56) of the loop of weft thread (56) to be caught by the knitting needle (32) lies below or, at the highest, at the same level as the head (62) of the knitting needle (32). The head (62) of the knitting needle (32) is associated, in the position in which it catches the thread, with a guide plate (52) with a guide cam (54, 72) such that the side (56) of the loop of weft thread to be caught is passed over the head (62) of the knitting needle and into the hook (64) of the knitting needle when the weft insertion needle (28) is run out of the shed. In order to improve the weaving operation and the woven product, the guide plate (52) is located on the side of the knitting needle (32) facing away from (26).

18 Claims, 4 Drawing Sheets

MECHANICAL LOOM

TECHNICAL FIELD

The invention relates to a mechanical loom having a weft insertion needle for inserting a loop of weft thread into a shed from one side and having a knitting needle on the side opposite to the shed, the knitting needle moving back and forth along the web of endless fabric to tie the loop of weft thread, where the weft insertion needle and the knitting needle are arranged such that the leg of the weft thread loop to be caught by the knitting needle lies below or, at the highest, at the level of a head of the knitting needle and where the head of the knitting needle, in the position in which it catches the tread, is associated with a guide plate having a guide track that runs at a slant to the path of the knitting needle in such a way that the leg of weft thread to be caught can be guided into the hook path of the knitting needle hook via the head of the knitting needle when the weft insertion needle is run out.

BACKGROUND OF THE INVENTION

A large number of mechanical looms for producing ribbons are known in the art. FIGS. 1 through 4 show four known basic methods of feeding a loop of weft thread 1, by means of a weft insertion needle 2, into a shed 4 created by warp threads 3. The loop of a weft thread 1 is inserted on one side of the shed 4, and on the opposite side of the shed 4 a knitting needle 5 is provided where one leg 6 of the weft thread loop 1 is inserted and tied. In FIGS. 1 through 4 all identical parts have the same reference numbers and the modified embodiments in FIGS. 1 through 4 are distinguished by the addition a through d.

In the embodiment variant in FIG. 1 the knitting needle 5*a* moves back and forth linearly, and the leg of weft thread 6*a* is inserted into the hook of the knitting needle by means of a press down device 7 that moves up and down. The press down device 7 represents an additionally activated component which complicates the design of a mechanical loom, increases the number of expendable parts, and in particular, it also has a negative effect on its performance. The design example in FIG. 2 is not equipped with a press down device. Instead, the knitting needle 5*b* is required to describe a down and up looped movement 8 in order to take hold of the leg of weft thread 6*b*. Again, additional mechanisms are required in order to achieve the knitting needle's 5*b* looped movement 8 which results in the above described disadvantages.

In the embodiment variant in FIG. 3 the knitting needle 5*c* moves in a circular path in order to catch the leg of weft thread 6*c* of the weft insertion needle 2*c*. This, however, is feasible only if the knitting needle 5*c*, which is a latch type knitting needle having a latch 74, moves in a large circular path W and moves back jerkily and quickly. This type of design is highly susceptible to wear and tear and to vibrations and is entirely unsuitable for high operating speeds. Also, compound needles cannot be used in this type of operation due to the knitting needle's long stroke.

In the known embodiment according to FIG. 4 the feeding path of the weft insertion needle 2*d* lies above the head of the knitting needle 5*d*. A guide wire 9 projects into the moving path of the weft insertion needle 2*d* and presses the leg of weft thread 6*d* to be tied downward into the hook running path of the knitting needle 5*d*. The guide wire 9 forms a diagonal guide track 10 running from top to bottom whose angle a must be small as otherwise the thread does not slide downward. For this reason, this systems requires a relatively large distance D, which, in turn, can be achieved only by increasing the length of stroke of the knitting needle 5*d*. The relatively long stroke limits the operating speed of the mechanical loom and makes it unsuitable for the use of compound needles. An additional disadvantage of this system is that the guide wire 9 also presses the other leg 11 of the weft thread loop 1*d* against the running path of the knitting needle 5*d*. This often has the result that the hook of the knitting needle 5*d* also takes hold of the second leg of weft thread 11. Typically, this causes the loop of weft thread to break and consequently the mechanical loom comes to a stop. In addition, in this system the eye of the weft insertion needle 2*d* that leads the weft thread must move far beyond the fell of the cloth and consequently beyond the guide wire. This requires a significantly longer weft insertion needle. As a result, the needle is heavier and thus more susceptible to vibrations. The mechanical loom is unsuitable for high operating speeds.

Finally, a mechanical loom of the type described in the introduction is known from GB-PS 552 067. However, here the guide plate is arranged between the knitting needle and the fell of the cloth in order to support the knitting needle and to prevent its deflection against the web of endless fabric. This arrangement makes it more difficult to tie off the knitted selvedge loop and to pull it in tightly and fit it closely against the web of endless fabric.

Typically, mechanical looms of the above described type are not suitable for operation with compound needles or latch type needles with short knitting needle strokes and allow operating speeds of no more than up to 2000 revolutions per minute.

DISCLOSURE OF THE INVENTION

The object of the invention is to further improve a mechanical loom of the type described in the introduction.

This object is achieved by locating the guide plate on the side of the knitting needle opposite the shed. Due to the fact that the guide plate is provided on the side of the knitting needle opposite to the shed or the web of endless fabric on the side of the knitting needle away from the shed, respectively, the creation and tying of the selvedge loop is not impeded by any components between the knitting needle and the web of endless fabric, which increases the the mechanical loom's efficiency. Furthermore, it is possible to pull the selvedge loop tighter against the web of endless fabric, thus improving the quality of the knitted edge due to smaller selvedge loops.

The loop of the weft thread to be inserted is below, or at the highest, at the level of the head of the knitting needle and a stationary guide plate is provided on the side of the knitting needle opposite to the shed for inserting the leg to be engaged in the knitting needle into the knitting needle. For this reason, additional mechanisms and moving components are not required, and, in particular, a reliable engagement is achieved, and only by the leg of the weft thread to be processed with the knitting needle, and only in a very small working area. This permits that the strokes of the knitting needle can be very short, for example less than 15 millimeters. This, in turn, permits the use of compound needles or latch type needles which are required for mechanical looms that operate at high speeds. An additional, important advantage of the stationary guide plate of this type is the stabilization of the leg of weft thread, as the latter assumes a precisely defined position, thereby ensuring that the hook of the knitting needle catches it reliably. The short knitting needle strokes of max. 15 millimeters that are made possible with this invention result in very short knitting needles which decreases the susceptibility to deflection, vibration and wear. This also ensures that the leg of weft thread is caught reliably by the knitting needle. Thus, the mechanical loom according to the invention is characterized by a very simple, wear resistant design and permits high operating speeds of up to 6000 revolutions per minute.

Advantageous embodiments of the mechanical loom are characterized as follows:

a. The guide plate is equipped with a head piece that covers the head of the knitting needle at least partially;

b. The guide track running at a slant is designed as a slot, at least in that range where the leg of weft thread to be caught is guided via the head of the knitting needle into the hook path of the knitting needle hook so that the leg of the weft thread to be inserted can be forced into the hook path of the knitting needle hook;

c. The head of the weft insertion needle can be guided on a curved weft path;

d. The stroke of the knitting needle is not longer than 15 millimeters;

e. The knitting needle is designed as a compound needle; and, f. The knitting needle is designed as a latch type needle.

The embodiment of the mechanical loom pursuant to paragraphs a and b above prevents an uncontrolled engagement of the leg of weft thread in the knitting needle. In the embodiment pursuant to paragraph b the loop of weft thread is forced into the path of the knitting needle hook by means of a guide slot. This further increases the reliability of positioning and consequently the efficiency of the mechanical loom and the quality of the fabric to be produced.

In principle, it is possible for the weft insertion needle to describe a linear movement, but the moving path must then be at an angle to the knitting needle that differs by ninety degrees. An embodiment of the mechanical loom pursuant to paragraph c is more advantageous.

The above mentioned stroke of the knitting needle of maximum 15 millimeters, as defined in paragraph d, is of particular advantage. It particularly permits the use of compound needles in accordance with paragraph e and latch type needles in accordance with paragraph f which are indispensable for high operating speeds.

SHORT DESCRIPTION OF THE DRAWINGS

FIGS. 1 through 4 in the attached drawings show the above discussed state of the art. Exemplary embodiments of the solution according to the invention are described below by means of FIGS. 5, 6 and 7, as follows:

FIG. 5 the weaving range in a mechanical loom according to the invention, in top view.;

FIG. 6 the weaving range in the mechanical loom as a first embodiment of FIG. 5, along section VI—VI in FIG. 5, and FIG. 7 the weaving range in the mechanical loom as a second embodiment of FIG. 5, along section VI—VI in FIG. 5.

DETAILED DESCRIPTION OF THE INVENTION

Figure 1:
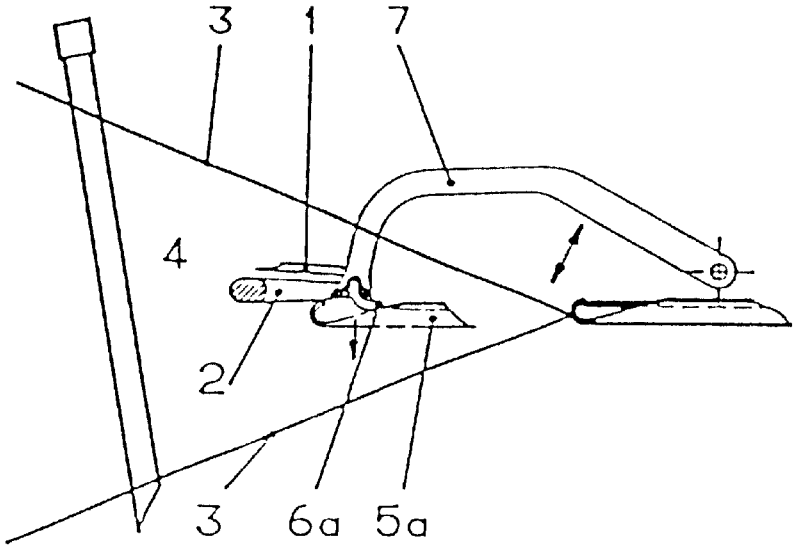
Fig. 1 (PRIOR ART)
Figure 2:
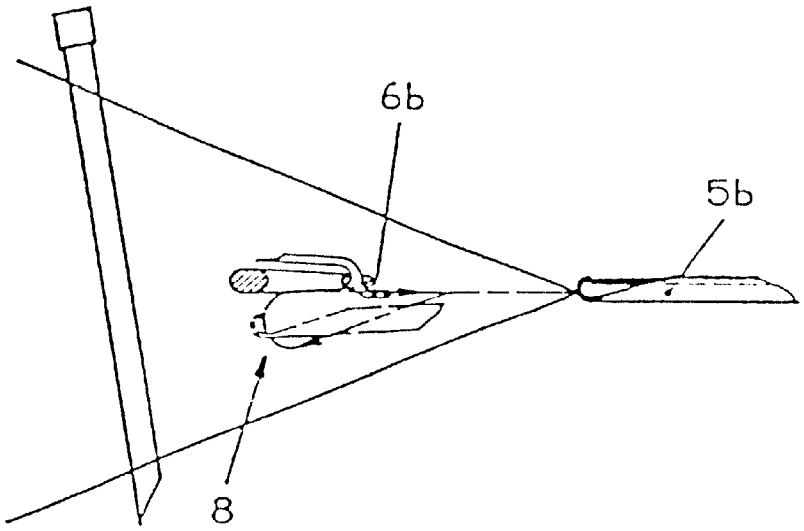
Fig. 2 (PRIOR ART)
Figure 3:
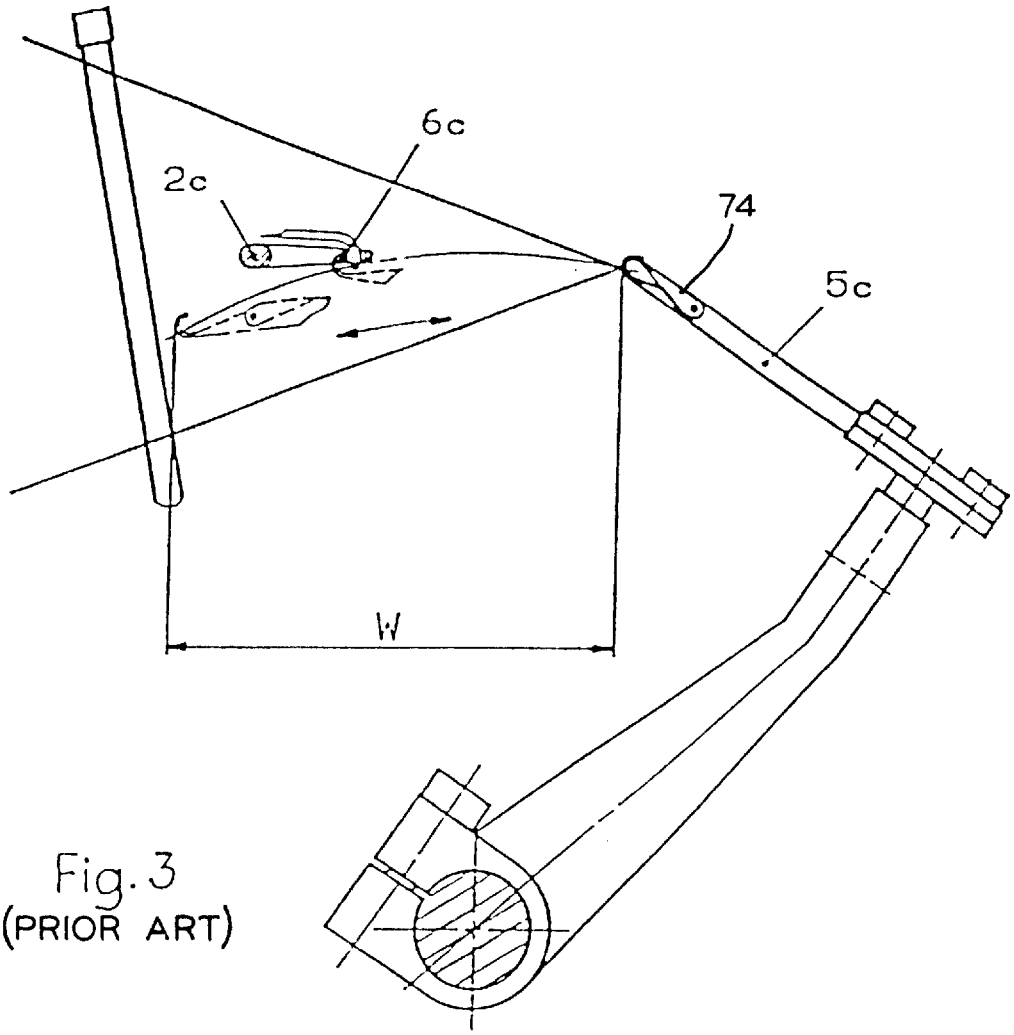
Fig. 3 (PRIOR ART)
Figure 4:
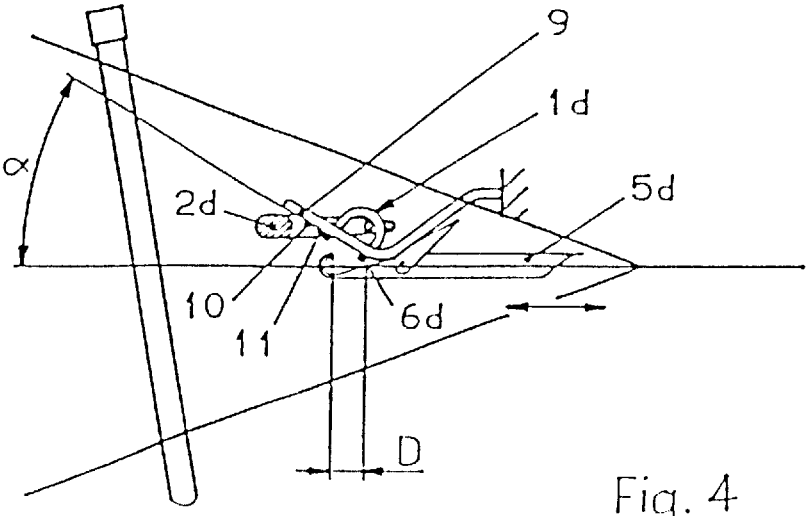
Fig. 4 (PRIOR ART)
Figure 5:
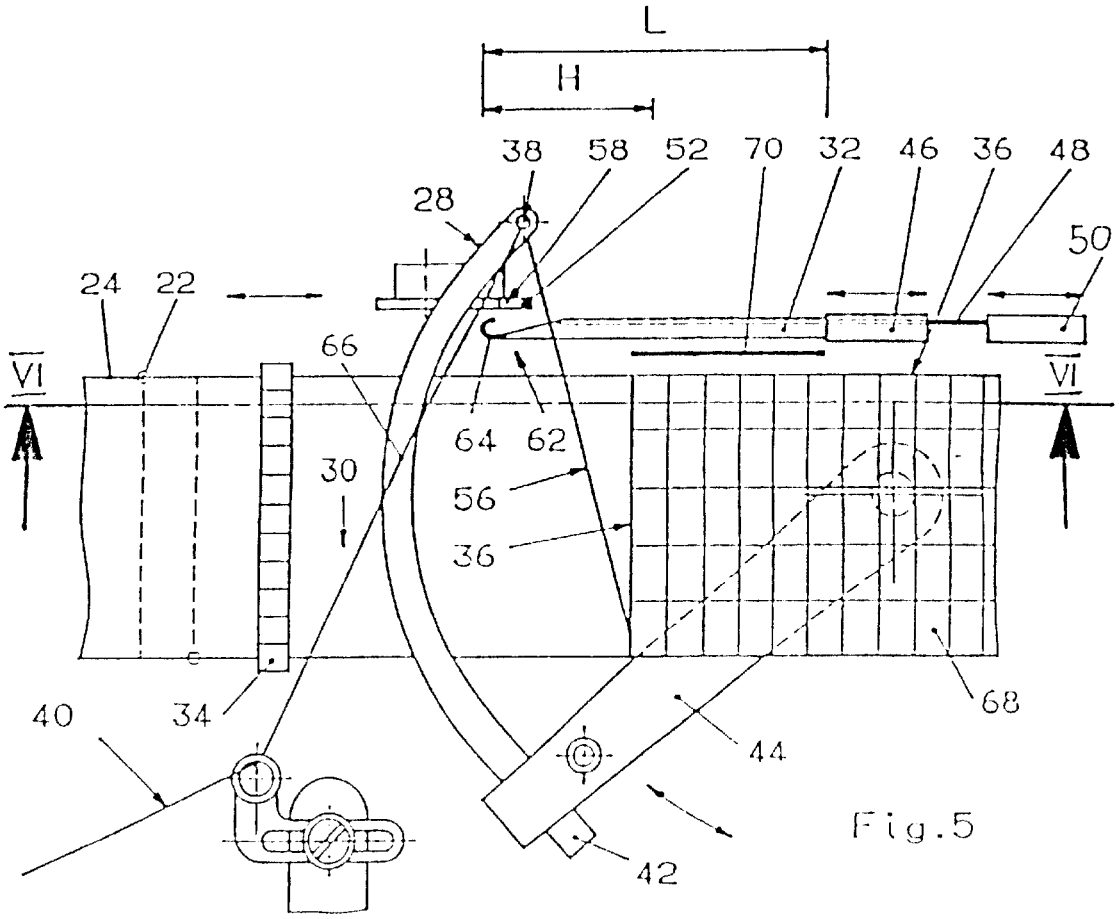
Figure 6:
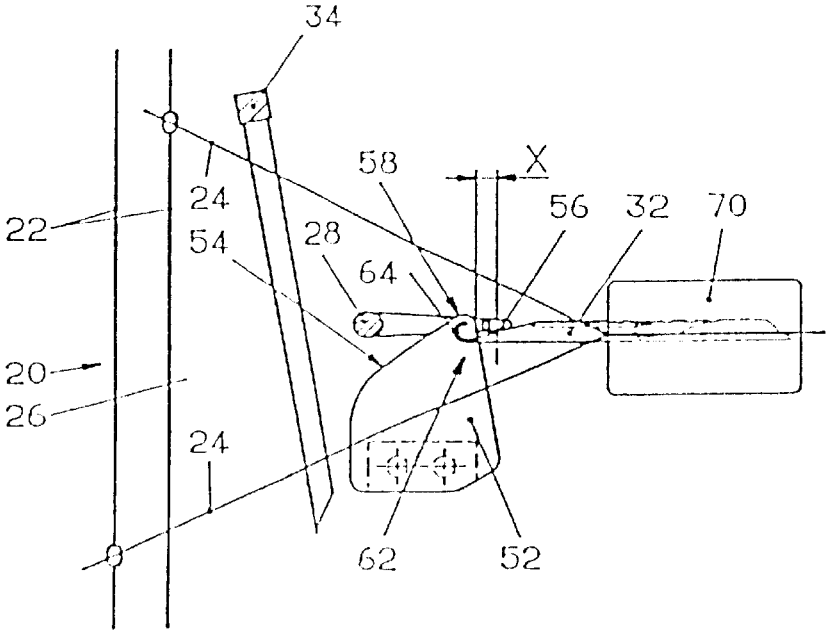
Figure 7:
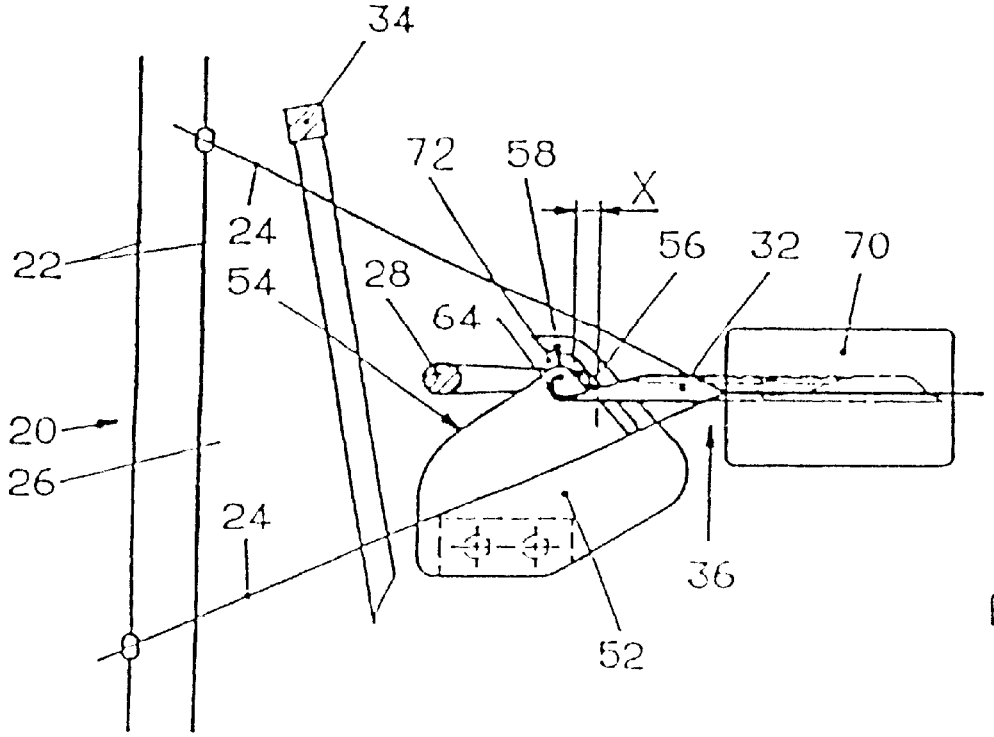

The mechanical loom shown in FIGS. 5, 6 and 7 comprises a shedding device 20, suggested only by heddles 22, which open warp threads 24 to form a shed 26 in a controlled manner. A weft insertion needle 28 serves to insert the loop of weft thread 30 into the shed 26 from one side. On the other side of the shed 26 the loop of weft thread 30 is tied by means of a knitting needle 32 which may be a latch type needle as, for example, shown in FIG. 3, that moves back and forth and is then looped to the fell of the cloth 36 by means of a weaving reed 34 when the weft insertion needle 28 is run out of the shed on the side of the knitting needle 32.

The weft insertion needle 28 is designed to be curved and is equipped with a threading eye 38 at the front end via which the weft thread 40 is formed into a weft thread loop 30 and fed into the shed. The back end 42 of the weft insertion needle 28 is clamped into an oscillating lever 44.

The knitting needle 32 is arranged on the side of the shed opposite to the weft side of the weft thread loop 30. In this particular case, it is designed as a compound needle. The knitting needle is mounted on a retainer 46 that moves back and forth, and the slide 48 is mounted on a retainer 50 that moves back and forth respectively. On the side of the knitting needle 32 that is opposite to the shed 26 a guide plate 52 is mounted stationary such that a front guide track 54, running at a slant to the knitting needle direction, serves to catch the leg 56 of the weft thread loop 30 to be tied in. The guide track 54 changes upward to a head piece 58 which covers the head 62 of the knitting needle. The weft insertion needle 28 is arranged and guided such that the loop of the weft thread 30 lies no higher than at the level of the head 62 of the knitting needle as shown in the exemplary embodiment. Advantageously, the knitting needle may also be placed lower. The head piece 58 is arranged such that only the leg of weft thread 56 to be looped is permitted to glide into the hook 64 of the knitting needle via the head piece 58, while the second leg of weft thread 66 is prevented therefrom. In addition, an edge plate 70 is provided between the knitting needle 32 and the web of endless fabric 68. This plate supports the tying of the loops. Due to the design pursuant to the invention only a very small working range X is required for the leg of weft thread 56 to be inserted correctly into the knitting needle 32. This also results in a short stroke H and a respectively short free distance L between the knitting needle 32 and the retainer 46.

In a second embodiment as per FIG. 7, the guide plate 52 is designed to have a slot 72 in order to further improve the guiding into the hook head of the knitting needle 32. The leg of weft thread to be inserted is forced through this guide slot 72 into the hook path of the knitting needle hook. This permits even higher operating speeds for the mechanical loom and eliminates undesired vibrations in the thread system.

This mechanical loom is particularly suitable to tie a loop of weft thread together with a preceding loop of weft thread which can be accomplished with or without an auxiliary thread as described in the Weaving System I and III, Hans Walter Kipp, Ribbon Weaving Technology, Heidelberg, 1988, pages 85 and 86.

I claim:

1. Mechanical loom having a weft insertion needle for inserting a loop of weft thread into a shed from one side and having a knitting needle on the side opposite to the shed, the knitting needle moving back and forth along the web of endless fabric to tie the loop of weft thread, where the weft insertion needle and the knitting needle are arranged such that the leg of the weft thread loop to be caught by the knitting needle lies below or, at the highest, at the level of a head of the knitting needle and where the head of the knitting needle, in the position in which it catches the thread, is associated with a guide plate having a guide track that runs at a slant to the path of the knitting needle in such a way that the leg of weft thread to be caught can be guided into the hook path of the knitting needle hook via the head of the knitting needle when the weft insertion needle is run out of the shed, characterized in that the guide plate is located on the side of the knitting needle facing away from the shed.

2. Mechanical loom pursuant to claim 1, characterized in that the guide plate is equipped with a head piece that at least partially covers the head of the knitting needle.

3. Mechanical loom pursuant to claim 2, characterized in that the guide track running at a slant is a slot, at least in that range where the leg of weft thread to be caught is guided via the head of the knitting needle into the hook path of the knitting needle hook, so that the leg of weft thread to be inserted can be forced into the hook path of the knitting needle hook.

4. Mechanical loom pursuant to claim 2, characterized in that a stroke of the knitting needle is not longer than 15 millimeters.

5. Mechanical loom pursuant to claim 2, characterized in that the knitting needle is a compound needle.

6. Mechanical loom pursuant to claim 2, characterized in that the knitting needle is a latch type needle.

7. Mechanical loom pursuant to claim 3, characterized in that the head of the weft insertion needle is supported on an oscillating lever whereby it can be guided on a curved weft path.

8. Mechanical loom pursuant to claim 3, characterized in that a stroke of the knitting needle is not longer than 15 millimeters.

9. Mechanical loom pursuant to claim 3, characterized in that the knitting needle is a compound needle.

10. Mechanical loom pursuant to claim 3, characterized in that the knitting needle is a latch type needle.

11. Mechanical loom pursuant to claim 7, characterized in that a stroke of the knitting needle is not longer than 15 millimeters.

12. Mechanical loom pursuant to claim 7, characterized in that the knitting needle is a compound needle.

13. Mechanical loom pursuant to claim 7, characterized in that the knitting needle is a latch type needle.

14. Mechanical loom pursuant to claim 1, characterized in that a stroke of the knitting needle is not longer than 15 millimeters.

15. Mechanical loom pursuant to claim 14, characterized in that the knitting needle is a compound needle.

16. Mechanical loom pursuant to claim 14, characterized in that the knitting needle is a latch type needle.

17. Mechanical loom pursuant to claim 1, characterized in that the knitting needle is a compound needle.

18. Mechanical loom pursuant to claim 1, characterized in that the knitting needle is a latch type needle.

* * * * *

UNITED STATES PATENT AND TRADEMARK OFFICE

CERTIFICATE OF CORRECTION

PATENT NO. : 5,954,098

DATED : September 21, 1999

INVENTOR(S) : Francisco Speich

It is certified that error appears in the above-identified patent and that said Letters Patent is hereby corrected as shown below:

On the title page, item [86], change "PCT/CH96/02730" to --PCT/CH96/00273--.

Col. 2, line 33, in the subtitle, change "DISCLOSURE" to --SUMMARY--.

Col. 4, line 2, after "32" insert --,--.

Signed and Sealed this

Ninth Day of May, 2000

*Attest:*

*Attesting Officer*

Q. TODD DICKINSON

*Director of Patents and Trademarks*